US006395319B1

(12) United States Patent
Öien

(10) Patent No.: US 6,395,319 B1
(45) Date of Patent: May 28, 2002

(54) PADDED HANDLE

(76) Inventor: Jan Harry Öien, P.O. Box 50, N-1620 Gressvik (NO)

( * ) Notice: Subject to any disclaimer, the term of this patent is extended or adjusted under 35 U.S.C. 154(b) by 0 days.

(21) Appl. No.: 09/555,891

(22) PCT Filed: Dec. 2, 1998

(86) PCT No.: PCT/NO98/00354

§ 371 (c)(1),
(2), (4) Date: Jun. 5, 2000

(87) PCT Pub. No.: WO99/29209

PCT Pub. Date: Jun. 17, 1999

(30) Foreign Application Priority Data

Dec. 5, 1997 (NO) ..... 975698

(51) Int. Cl.[7] ..... A45F 5/10; A45C 13/26

(52) U.S. Cl. ..... 426/132; 426/112; 426/104; 249/171; 249/137

(58) Field of Search ..... 426/104, 112, 426/132; 249/141, 171, 137

(56) References Cited

U.S. PATENT DOCUMENTS

| | | | | |
|---|---|---|---|---|
| 1,468,848 | A | * | 9/1923 | Wear |
| 1,691,467 | A | * | 11/1928 | Carver |
| 2,215,116 | A | * | 9/1940 | Crary |
| 2,274,605 | A | * | 2/1942 | Hoffmeister |
| 3,800,361 | A | * | 4/1974 | Stauffer |
| 3,912,140 | A | * | 10/1975 | Franges |
| 4,112,541 | A | * | 9/1978 | Tetradis |
| 4,262,385 | A | * | 4/1981 | Norman |
| 4,590,640 | A | * | 5/1986 | Enersen |
| 4,796,940 | A | | 1/1989 | Rimland |
| 5,005,891 | A | | 4/1991 | Lunsford |
| 5,083,825 | A | * | 1/1992 | Bystrom et al. |
| 5,257,845 | A | * | 11/1993 | Mcconnell |
| 5,364,148 | A | * | 11/1994 | Bartocci |
| 5,487,582 | A | * | 1/1996 | Bourgeois et al. ..... 294/171 |
| 5,658,029 | A | | 8/1997 | Franko |

FOREIGN PATENT DOCUMENTS

| | | | | |
|---|---|---|---|---|
| DE | 8507965 | | 3/1989 | |
| GB | 2138663 | A | 10/1984 | |
| GB | 2284145 | A | 5/1995 | |
| JP | 62-36151 | * | 2/1987 | ..... 426/87 |

OTHER PUBLICATIONS

Chicago Tribune, Section: Food Guide, p. 8 (Dialog Abstract 01719122, Item 12, File 632), Nov. 29, 1990.*

Philadelphia Inquirer, Section: Features Food, page F01 (Dialog Abstract 05840152, Item 7, File 633), Dec. 5, 1990.*

* cited by examiner

*Primary Examiner*—Steven Weinstein
(74) *Attorney, Agent, or Firm*—Young & Thompson

(57) ABSTRACT

A padded handle (1) comprising preferably one piece of flexible filling material, which is arranged to be guided through two or more handle grips and where two opposing edges of the padded handle (1) have assembled corresponding locking mechanisms (2, 5) arranged to lock the two opposing edges loosely together, with an inner surface (3) surrounding the handles. That which is new and distinguishing is, among other characteristics, the fact that the padded handle in its unbent, mainly flat form, has an elliptical horizontal projection which comprises a minimal area in relation to the length and breadth of material which is necessary in order to fulfill the function of compression distribution, while at the same time covering the handles; and where the padded handles' edible material after use may be opened up and consumed.

2 Claims, 2 Drawing Sheets a)
b)
c)
d)
1
2
3
4
5

PADDED HANDLE

The invention concerns a padded handle which consists of preferably one piece of flexible laminated or non-laminated filling material positioned in such a way that it can be put through at least two handle openings; where two opposite edges of the padded handle have assembled corresponding locking systems arranged to lock the two opposite edges loosely together, with an inner surface surrounding the handles; where the padded handles, in their unbent, mostly flat form, have preferably an elliptical horizontal projection which comprises a minimal surface in relation to the length and breadth of material which is necessary in order to fulfill its role as a compression distributor, while at the same time covering the handles.

Carrier bags and other packing items with handles, for example formed handles on typical carrier bags, paper handles assembled on paper carrier bags and sealed plastic strips assembled on cartons, are usually experienced as cutting into the palm of the hand or cutting into one's fingers when one has to carry the bag or carton. Both the fact that the entire load is distributed over a small, horizontal area in the hand, and the fact that even the handle itself has a tendency to stretch and contract when one is carrying, means that the handles, due to friction, cut into the palm of the hand. There are many padded or lined handles available which can be assembled onto regular carrier bag handles, or bands which are available, which allow the load to be evenly distributed over a larger area of the hand and which remove some of the risk of the handles cutting into the palm of the hand, or into the fingers at the front and back of the hand.

One such padded or lined handle is the U.S. Pat. No. 5,005,891. This extra handle is a thin sheet of paper or a sheet of semi-stiff flexible material which can be folded in under the handles and forms a kind of tube which surrounds the handles. A hole and a broad clip with a narrow shank is also placed in the middle of two opposite ends of the sheet or plate; the clip is pulled through the opposite hole and thereby locks the tube shape around the handles. The locking mechanism means that the padded handle functions as a holder for the handles of one or more carrier bags, even if one lets go.

A similar bendable and lined, padded or compression distributing handle is illustrated in U.S. Pat. No. 4,796,940. This handle is also designed to close opposite ends by means of so-called "suitable locking elements": for example, a patent button, tape or snaplock.

The known carrier bag handles' linings have a rectangular or quadratic form, they are flexible and can be connected together edge to edge with the aid of a button or something similar. The known designs which are older than those mentioned, and which are also described in the introduction to the American patents, are not flexible, but have a solid shape such as a hollow arched track or something similar and take up too much packing and storage space.

The patent presented here is designed to solve several problems simultaneously: Firstly, it should relieve the relatively high pressure on the palm of the hand which occurs when carrying a normally loaded carrier bag of groceries containing, for example, 4 liters of milk, ½ kg of meat, ½ kg of vegetables, 1 kg of jam and 1.5 liters of soft drinks, ie: 7.5 kg of goods. All experience shows that a carrier bag containing such an amount of groceries can be a little uncomfortable to carry for a distance of any more than a few hundred meters —even if this is considered to be a moderate load.

The pressure from the handles can hurt the fingers relatively quickly. With a better grip, ie: a grip where the pressure is more evenly distributed, one would be able to carry the bag in a much more pleasant and effective manner.

Secondly, the invention's design should hold the handles together after one has put the carrier bag(s) down. It has been established that most groceries are transported home either by means of a personally owned car or by public transport. One advantage of this invention, therefore, is that it holds the handles of the carrier bag together, even after one has put the bag(s) down, either placing them in the boot of a car or on the floor (or seat) of a public transport vehicle. This contributes to maintaining the cleanliness and hygiene of the groceries, by preventing the items from falling out of the carrier bag(s) when they are put down.

Thirdly, one of the purposes of the invention is that it would require less raw materials to produce than the present technique, due to the fact that it has a horizontal projection which has the least possible area in relation to the extension, pressure and tension force for which it was calculated.

Fourthly, one of the purposes of the design is that it either covers or consists of a material which has the additional feature that, after it has been used as a lining or padding for the handle, it can be consumed. This provides an element of surprise and may serve as a pleasure bringing quality in relation to the invention in its preferred design. This element of surprise also includes the reaction to the product of those dealing with the packaging, as they have been involved in the secret preparations for production.

An additional purpose is to acquire a padded or lined handle arranged to be piled effectively, or which can be hung up on a "shock sales" pin.

Yet another purpose is that the padded handle would be able to carry symbols which identify, for example, one of the distributive trademarks, or the padded handle's manufacturing number by means of a series of numbers, for example with a lottery in mind, or similar symbols. These symbols can, in the preferred design of the invention, be printed or impressed on the surface of the padded handle, or as a semi-transparent symbol in the padding material itself The invention concerns a piece of flexible material which is intended to be put through at least two or more handles on carrier bags for groceries or other goods; and where two opposite edges of the piece of material have assembled corresponding locking devices arranged to lock the two opposite edges loosely together around the handles. That which is new and which characterises this invention is that the padded handle preferably has an elliptical form which comprises a minimal area in relation to the length and breadth of the material which is necessary to use in order to fulfill the function of compression distribution, while at the same time covering the handles; and where the material can be consumed after having served its purpose as a padded handle.

Figure 1:
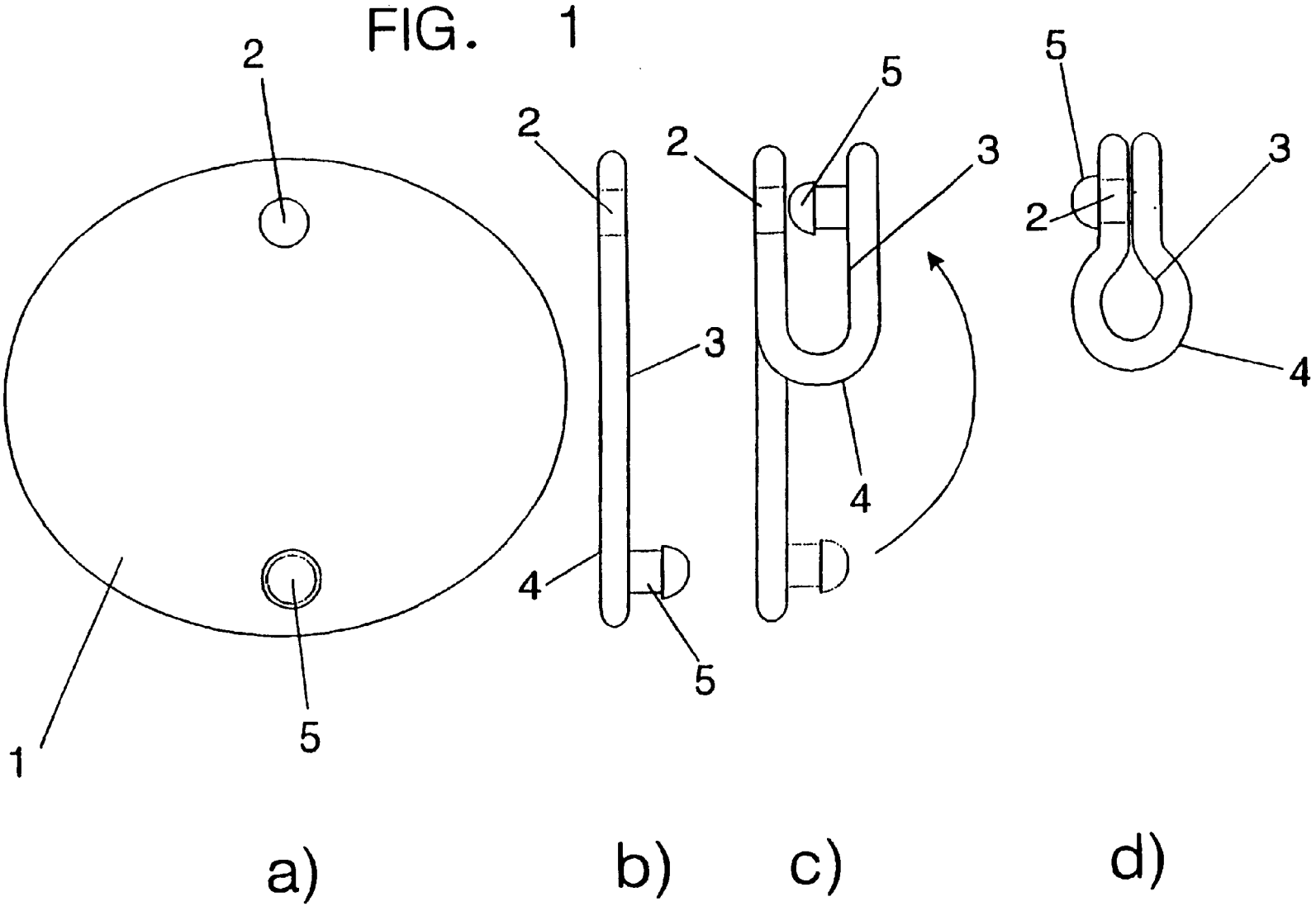
FIG. 1*a* illustrates a horizontal projection over a mainly elliptically formed padded handle (1) for carrier bags, where the padded handle (1) is unfolded or unbent. In a preferred design, the locking mechanisms outside the handle have a flap (6) which is situated in connection with a covering foil on the locking mechanism (2) or (5), in the case where (2) or (5) is a glue lock.
FIG. 1*b* illustrates a lateral projection over the same padded handle (1), with a potential outer surface (4) and inner surface (3), where the locking mechanisms (2,5) are also seen from the lateral projection.
FIG. 1*c* illustrates in the lateral projection how the padded handle (1) is bent into, for example, two handle grips (not shown) and also where the locking mechanisms (2,5) are brought into position before contact.
FIG. 1*d* illustrates the padded handle (1) in the lateral projection bent round the handles (not shown) with the inner surface (3) facing towards the handles and also where the locking mechanisms (2,5) are brought loosely, but firmly into contact.
Figure 2:
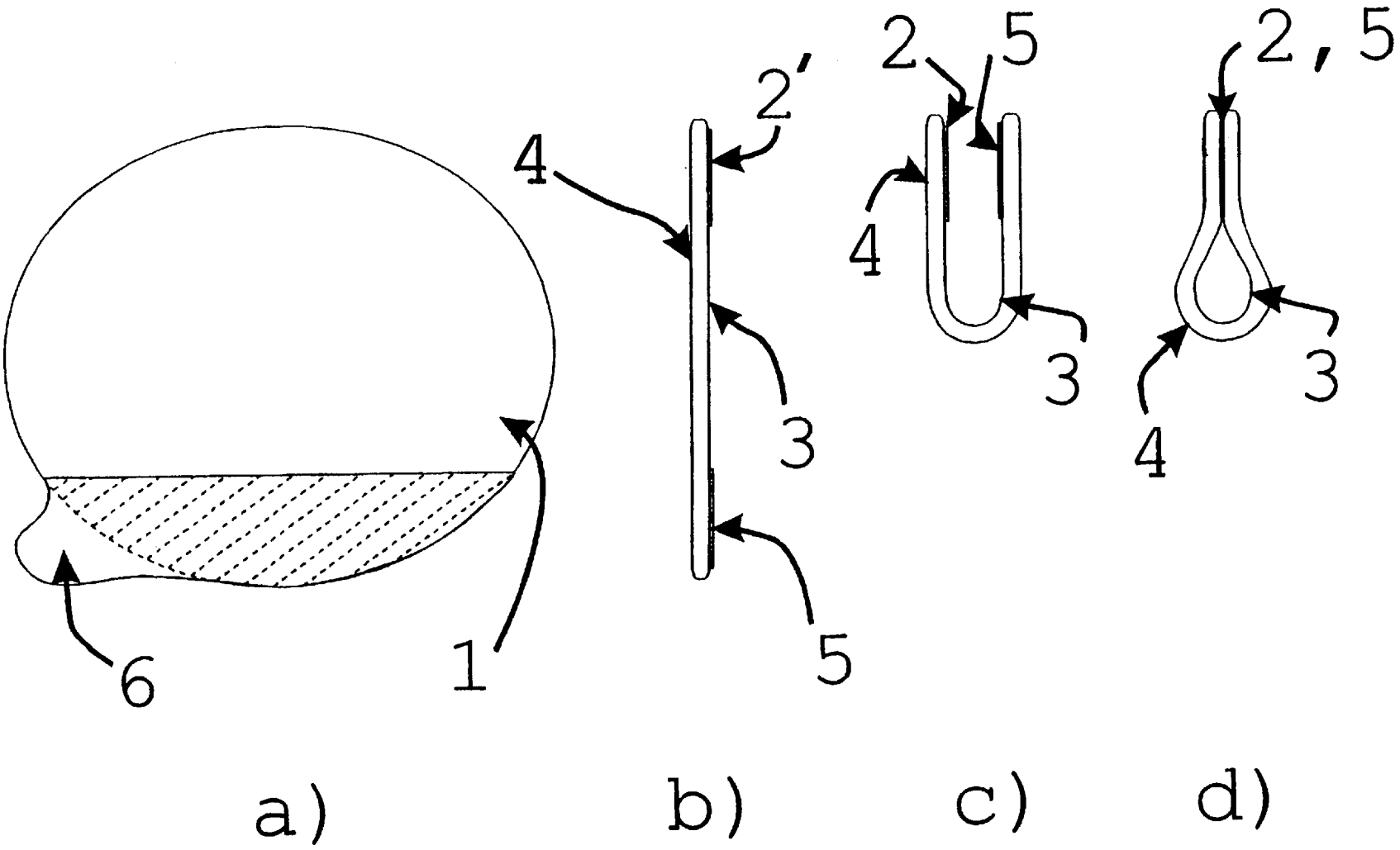
FIGS. 2*a*–2*d* are views similar to FIGS. 1*a*–1*d*, respectively, but show an alternative embodiment in which closure is achieved by adhesion, a tab 6 being provided for opening purposes.

The material in the padded handles (1) is preferably made of an edible foodstuff, which also possesses the mechanical padding qualities needed in order to distribute the pressure from the handles' narrow profiles, through the padded handle (1) and down into a larger, broader surface area in the handle (not shown). One such edible material is for example wine gum in a preferred design. Another preferred design could be liquorice or, for example, a combination of coated wine gum and liquorice. A further variation of the invention could consist mainly of caramel, chocolate or any other edible material. The padded handle's inner surface (3) and outer surface (4) consists preferably of a thin foil which should preserve the padding material itself. This could be a thin plastic, polyester, polyethylene or aluminium foil. The locking mechanisms (2,5) are in a preferred design assembled directly onto the surrounding inner and outer surface-designing foil (3,4).

This inner and outer surface foil does not in and of itself contribute to any great degree to the mechanical qualities of the padded handle; but it does, however, contribute in the sense that it maintains the handle's padding material clean and hygenically packed; while at the same time, in its preferred design, it assists in supporting the locking mechanisms.

This padded handle is an alternative design which is intended to provide a kind of emergency ration: for example, as padding on a handle for aid operations. It could then contribute to the facilitation of transferring "strapped" (band sealed) parcels and would, after transport has been carried out, be able to be consumed on the spot. It could also be marked with its final destination for transportation, owner organisation and other such information.

In a preferred design, the horizontal projection of the padded handle is elliptical. The existing U.S. patents we have given as the known technique, both consist of flexible rectangles. Imagine that the length of the rectangle is 2*a* and the breadth is 2*b*. The area of a rectangle with 2*a*=10 cm and 2*b*=8 cm, would then be 2*a**2*b*=4*ab*(=80 cm2). An area of an ellipse with corresponding semi-axes 2*a*=10 cm and 2*b*=8 cm, would then be pi*a*b=3,14*5*4 cm2 (=62.8 cm2). This is calculated to be a saving of 17.2 cm2 for only one single padded handle, or almost 25% of the total material used.

What is claimed is:

1. A flexible detachable padded handle for handled carrier bags to distribute the load of the bag handles more evenly; said padded handle comprising an inner surface comprising a flexible foil and an outer surface comprising a flexible foil and a padding material located between the inner and outer surfaces wherein the padding material comprises an edible foodstuff and wherein the inner and outer flexible foil surfaces maintain the edible foodstuff padding material clean and hygienically packed; the padded handle being flat with an elliptical perimeter in its unfolded form and being capable of being folded; said padded handle having corresponding locking mechanisms at respective opposing edges of the padded handle and the padded handle being dimensioned to be put through at least two handle openings of the bag and be folded over the at least two handle openings such that when the padded handle is folded around the bag handles, the respective opposing edges of the padded handle are brought together and the corresponding locking mechanisms are capable of locking the two opposite edges loosely together around the bag handles; the edible foodstuff padding material being capable of providing the mechanical padding qualities sufficient to distribute the pressure of the bag handles and being consumable upon removal of the flexible foils.

2. A flexible detachable padded handle according to claim 1, wherein said flexible foil is plastic foil or aluminum foil.

* * * * *